US006252553B1

(12) United States Patent
Solomon

(10) Patent No.: US 6,252,553 B1
(45) Date of Patent: Jun. 26, 2001

(54) MULTI-MODE PATCH ANTENNA SYSTEM AND METHOD OF FORMING AND STEERING A SPATIAL NULL

(75) Inventor: Moise N. Solomon, Chelmsford, MA (US)

(73) Assignee: The Mitre Corporation, McLean, VA (US)

( * ) Notice: Subject to any disclaimer, the term of this patent is extended or adjusted under 35 U.S.C. 154(b) by 0 days.

(21) Appl. No.: 09/478,221

(22) Filed: Jan. 5, 2000

(51) Int. Cl.[7] ..... H01Q 1/38

(52) U.S. Cl. ..... 343/700 MS; 343/850

(58) Field of Search ..... 343/700 MS, 846, 343/778, 829, 830, 850, 852; H01Q 1/38, 21/06

(56) References Cited

U.S. PATENT DOCUMENTS

| | | | | |
|---|---|---|---|---|
| 4,191,959 | | 3/1980 | Kerr . | |
| 4,410,891 | | 10/1983 | Schaubert et al. . | |
| 4,547,779 | * | 10/1985 | Sanford et al. | 343/700 MS |
| 4,564,842 | | 1/1986 | Suzuki . | |
| 4,771,591 | | 9/1988 | Ermacora . | |
| 4,887,089 | | 12/1989 | Shibata et al. . | |
| 5,003,318 | | 3/1991 | Berneking et al. . | |
| 5,006,859 | | 4/1991 | Wong et al. . | |
| 5,124,713 | | 6/1992 | Mayes et al. . | |
| 5,210,542 | | 5/1993 | Pett et al. . | |
| 5,241,321 | | 8/1993 | Tsao . | |
| 5,243,353 | | 9/1993 | Nakahara et al. . | |
| 5,319,378 | | 6/1994 | Nalbandian et al. . | |
| 5,323,168 | | 6/1994 | Itoh et al. . | |
| 5,394,159 | * | 2/1995 | Schneider et al. | 343/700 MS |
| 5,444,453 | | 8/1995 | Lalezari . | |
| 5,448,250 | | 9/1995 | Day . | |
| 5,461,387 | | 10/1995 | Weaver . | |
| 5,515,057 | | 5/1996 | Lennen et al. . | |
| 5,548,297 | | 8/1996 | Arai . | |
| 5,561,435 | | 10/1996 | Nalbandian et al. . | |
| 5,598,168 | | 1/1997 | Evans et al. . | |
| 5,668,558 | | 9/1997 | Hong . | |
| 5,691,726 | | 11/1997 | Nichols et al. . | |
| 5,712,641 | | 1/1998 | Casabona et al. . | |
| 5,781,158 | | 7/1998 | Ko et al. . | |
| 5,940,037 | * | 8/1999 | Kellerman et al. | 343/700 MS |

* cited by examiner

*Primary Examiner*—Tho G Phan
(74) *Attorney, Agent, or Firm*—Rosenberg, Klein & Lee

(57) ABSTRACT

A hand-held antenna specifically for GPS applications is provided which includes a microstrip patch antenna having a ground board, a single radiating patch spaced from the ground board and a resonant cavity defined between the ground board and the single radiating patch. Feed points are provided, one in the geometrical center of the radiating patch, and one, two, or four equidistantly spaced from the central feed point and disposed at 90° angular intervals. A feed network couples fundamental modes of excitation to the side feed points on the patch and a higher mode of excitation to the central feed point. Amplitude and phase controllers are provided in the feed network for amplitude and phase shifting between the fundamental and higher order modes of excitation in order to steer a spatial null in azimuth and elevation.

11 Claims, 7 Drawing Sheets

MULTI-MODE PATCH ANTENNA SYSTEM AND METHOD OF FORMING AND STEERING A SPATIAL NULL

FIELD OF THE INVENTION

The present invention relates to a single element, multi-mode patch antenna system capable of forming a spatial null, and more particularly, to a patch antenna system which uses fundamental and higher order modes within a single microstrip patch radiator which is capable of forming a spatial null in the vicinity of the horizon where a jamming or interference threat is the greatest. More in particular, the present invention relates to an antenna system for GPS application which is provided with a feed network for uniquely feeding a single microstrip patch radiator for forming a spatial null and steering the created spatial null in azimuth and elevation thereof.

DESCRIPTION OF THE PRIOR ART

Hand held GPS receivers have revolutionized navigation in many areas. However, current military hand held receivers are vulnerable to jamming, both intentional and unintentional. For GPS applications, the receiving antenna pattern is necessarily hemispherical which further increases its vulnerability to jamming. Adaptive antennas and associated receiver electronics do exist, generally however, they rely on antenna arrays which are physically large for practical hand held use. Small arrays of two elements may be used to steer a single null in azimuth and elevation by combining their received signals with suitable amplitude and phase weighting. A miniature single element GPS receiving antenna for hand-held application capable of forming and steering a spatial null in azimuth and elevation has therefore become a need in navigation, military, and commercial areas of application.

Antennas have evolved in a wide variety of types, sizes, and degrees of complexity. For many military and commercial communication systems, such as Global Positioning Systems (GPS), as well as microstrip or patch antennas which have been widely used due to their lightweight, low cost, and low profile characteristics. Typically, a patch antenna includes a ground plane and a rectangular or circular patch radiator stacked on the ground plane and separated therefrom by a dielectric substrate or an air filled cavity.

In this form, the patch antenna constitutes essentially a pair of resonant dipoles formed by two opposite edges of the patch. The patch is of such dimension that either pair of adjacent sides can serve as halfway radiators, or the resonant dipole edges may be from approximately a quarter wavelength to a full wavelength long.

The GPS antenna receives satellite signals from a multiplicity of satellites located virtually anywhere overhead from horizon to horizon. It has been found that the circular polarization of the satellite signals is necessary and desirable. Thus, the incoming satellite signal has a right hand circular polarization. The GPS antenna system is also required to have circular polarization to exclude the dependence of the received signal amplitude on azimuth and elevation angle of the incoming satellite signal, i.e., to exclude polarization mismatch effects.

Additionally and in conjunction with the requirement for circular polarization of the GPS receiver antenna, a broad bandwidth is needed for receiving GPS signals.

The prior art discloses a number of Patents on microstrip patch antennas with circular polarization and broad bandwidth. For example, U.S. Pat. No. 5,319,378 describes a multi-band microstrip antenna capable of dual frequency operation. The antenna comprises a microstrip having a thin rectangular metal strip that is supported above a conductive ground plane by two dielectric layers which are separated by an air gap or other lower dielectric constant material. The antenna feed is a coaxial transmission line that provides a mechanism for coupling the antenna to an external circuit. The spaced dielectric layer and the air gap produces higher order modes in addition to the lower order mode, which causes dual frequencies of operation. This system is, however, susceptible to jamming.

U.S. Pat. No. 5,003,318 discloses a dual frequency microstrip patch antenna with capacitively coupled feed utilizing a stacked arrangement of circular radiating patches separated by a layer of dielectric for receiving signals transmitted by the GPS satellite. The upper stacked patches are further separated by another layer of dielectric from a pair of separated ground planes. A modal shorting pin extends between the patches and ground planes, and the patches are fed through a pair of feed pins by a backward wave feed network.

The shorting or modal pin in the center of each patch forces the antenna element into the TM01 mode. This modal pin connects the center of each radiating patch to the ground plane. When the upper patch is resonant, it uses the lower patch as a ground plane. The lower patch operates against the upper ground plane and acts nearly independently of the upper element. The antenna is fed through the two feed pins which are oriented at right angles to each other to excite orthogonal mode and are 90° out of phase to achieve circular polarization. The bandwidth of the antenna is increased by increasing the thickness of the dielectric material between the radiating patches.

As stated in the '318 Patent, the antenna enjoys increased bandwidth including a wider frequency operating range, and a wider operating range for a prescribed antenna gain which permits its use with a GPS system. Additionally, this prior art includes an adaptive nulling processor for interference rejection. The wider bandwidth permits the processor to develop deep nulls over a wide frequency range as is necessary for this system. The specifics of the adaptive nulling arrangement are not however described in the Patent. However, the stacked arrangement of a pair of ground boards and two patches with a plurality of dielectrical spacers therebetween is highly complex and is labor intensive in the manufacture of the system. The antenna limits itself to circularly shaped radiating patches and denies any other contours for radiating patches of the antenna.

U.S. Pat. No. 5,712,641 discloses an interference cancellation system for global positioning satellite receivers in which the orthogonally polarized components of the composite received signal are separated by the receiving antenna arrangement and adjusted in the polarization feed adaptor network between the antenna and GPS receiver to optimally cancel components.

The antenna and installation arrangement creates a polarization filter relative to interference sources which changes their apparent polarization orientation and support adaptive discrimination based on dissimilar polarization characteristics relative to the desired signals. The orthogonally received signal components from the GPS satellite and from interference sources are combined to adaptively create cross-polarization nulls that try to attenuate interference sources while slightly modifying the GPS received signal.

The orthogonal components of the received environment signal are filtered, amplified, and transmitted from the antenna system to the nulling system in each GPS band using separate cables. In the case of the L2 bypass configuration, the right hand circular polarization signal may be developed at the antenna entrance. A sample of the interference signal in each band of the GPS channel is detected and processed to identify interference conditions wherein control signals are produced that are applied to the adaptive antenna circuit in each band of interest that controls the effective tilt angle and ellipticity of the combined antenna system.

The effective polarization property of the antenna system is controlled so as to cross polarize or mismatch the antenna to the interference source and thus null or suppress the interference signal in the channel containing the GPS signal. However, this prior art system does not suggest using the fundamental TM010 and the TM001 mode and the higher order mode in the single patch antenna system in order to create a radiation pattern having a special null in the desired direction. Additionally, it does not suggest weighting the amplitude and phase between the fundamental and higher order modes steering the spatial null U.S. Pat. No. 5,461,387 is directed to a direction finding multi-mode antenna for a GPS receiver. A feed circuit is connected to the direction finding antenna for receiving signals from the GPS antenna and for generating mode 1 and mode 2 signals. A mode 1 pattern is generated by feeding the antenna so that the relative phase between the arms of antenna is 90°. Mode 2 is generated by feeding the arms of antenna so that the relative phase between the arms is 180°. The mode 1 pattern is a broad pattern that covers most of this type, while the mode 2 pattern has stronger lobes off axis but has a null located on the vertical axis. The antenna configuration is however a four arm spiral antenna as opposed to a microstrip patch antenna.

SUMMARY OF THE INVENTION

It is therefore an object of the present invention to provide a technique for forming and steering a spatial null in a radiation pattern of a microstrip patch antenna for a GPS receiver.

It is a further object of the present invention to provide a miniature, low weight and low profile microstrip antenna having a single radiating patch separated from a ground board by an air filled cavity and having a central feed point located in the geometrical center of the radiating patch. The subject system also includes at least a pair of side feed points spaced from the central feed point equal distances and orthogonally disposed with respect to each other wherein fundamental modes TM010 and TM001 phase shifted by 90° are electrically coupled to the orthogonal side feed points to form a typical right hand circularly polarized bore sight antenna pattern, and, wherein the higher order TM020 or TM002 modes are also created simultaneously in the same radiating patch and electrically coupled to the central feed point to generate a monopole antenna type pattern with a null at the bore sight.

It is a further object of the present invention to provide a simple low cost adaptive antenna capable of forming a null in the vicinity of the horizon where the jamming threat is the greatest.

It is still another object of the present invention to provide a compact hand-held antenna element capable of steering a spatial null.

It is a still further object of the present invention to provide a miniature adaptive nulling antenna which when integrated with a low cost receiver, can be used for portable GPS application.

It is another object of the present invention to provide a technique for creating and steering a spatial null in a radiation pattern of a single element miniature antenna by means of exciting the antenna in fundamental and higher modes of operation and properly weighting amplitude and phase shift therebetween.

The teaching of the present invention may find its utility in navigational, military, or commercial applications, however, preferably it is to be used as a hand held antenna system for GPS (Global Positioning System) and personal communications applications.

In accordance with the teachings of the present invention, an antenna system comprises a microstrip patch antenna which includes a ground board, a single radiating patch installed in spaced relationship to the ground board, and a dielectric field resonant cavity defined between the ground board and the single radiating patch.

A central feed point is disposed in the geometrical center of the single radiating patch, and at least one, but preferably, two, or four, side feed points are positioned on the single radiating patch and spaced from the central feed point a predetermined distance. The number of the side feed points depends on the application of the antenna system of the present invention. For GPS applications, it is generally necessary that at least a pair of side feed points be employed in the antenna. If two or more side feed points are employed, they are angularly spaced 90° from each other.

A feed network is coupled to the radiating patch in order to supply a predetermined electromagnetic field into the resonant cavity for injecting and extracting energy therefrom and for forming a desired radiation pattern of the antenna. Specifically, the feed network includes a first path for coupling a fundamental mode of excitation to at least one of the side feed points, and a second path for coupling a higher order mode of excitation to the central feed point.

Particularly for GPS applications, the first path of the feed network couples the fundamental TM010 and TM001 modes (which are 90° phase shifted with respect to each other) to first and second side feed points to form a typical right or left hand circularly polarized bore sight antenna pattern for receiving GPS signals. The second path simultaneously couples the weakly excited higher order TM020 or TM002 mode to the central feed point to generate a monopole antenna type pattern with a spatial null at boresight. The higher order modes have a threshold cut-off resulting from carefully chosen dimensions of the radiating patch, but can be weakly excited by matching the large higher order mode impedance at the center of the patch. Either one of the first and second paths of the feed network may include amplitude and phase controllers, so that by properly weighting the amplitude and phase shift between the fundamental and the higher order modes, a spatial null can be formed in the desired direction throughout an angle of 360°. It is of more importance that the spatial null is easily formed in the vicinity of the horizon where the jamming threat may be the greatest.

It is envisioned that each of the first and second paths of the feed network includes feed probes and coaxial transmission lines terminating in the feed probes. Each feed probe protrudes through the ground board for direct electrical contact with the feed points (central and side ones) on the single radiating patch, and extend through the resonant cavity for injecting and extracting energy therefrom.

The first path of the feed network includes a first arm coupled at one end thereof to a first side feed point, a second arm coupled at one end thereof to the second side feed point, a 90° phase shifter coupled in one of the first and second arms and a combiner coupled between second ends of the first and second arms. A first line in the first path of the feed network is coupled to the output of the combiner.

The second path of the feed network includes a second line coupled by one end thereof to the central feed point. An amplitude controller is coupled in either one of the first or second lines between the ends thereof. A phase controller is coupled in either one of the first and second lines between the ends thereof. A second combiner is coupled between the second ends of the first and second lines to combine the output signals from each one. A third line is coupled to the output of the second combiner for receiving a combined output signal from the feed network and for providing the combined output signal to a processing means, for instance, a GPS receiver.

The phase controller controls location of the spatial null in azimuth; and the amplitude controller controls location of the spatial null in elevation.

The single radiating patch may have any acceptable contour or shape, including rectangular, circular, triangular, etc., as long as the radiating patch is symmetrically contoured.

The present invention further constitutes a method of forming a radiation pattern having a spatial null in a desired direction which includes the steps of:

(1) providing a patch antenna which includes a ground board, a single radiating patch spaced from the ground board, and a dielectrical field resonant cavity defined therebetween, (2) providing a feed network comprising (a) a first path connected to a pair of side feed points on the single radiating patch, and (b) a second path connected to the central feed point, (3) coupling first and second 90° phase shifted fundamental modes of excitation to the first and second side feed points through the first path of the feed network, and simultaneously coupling a higher order mode of excitation to the central feed point thereby creating a radiation pattern having a spatial null in a desired direction.

The fundamental modes of excitation are amplitude and phase shifted with respect to the higher order mode of excitation to steer the spatial null in elevation and azimuth.

These and other novel features and advantages of this invention will be fully understood from the following detailed description of the accompanying drawings.

DETAILED DESCRIPTION OF THE PREFERRED EMBODIMENTS

Figure 1A:
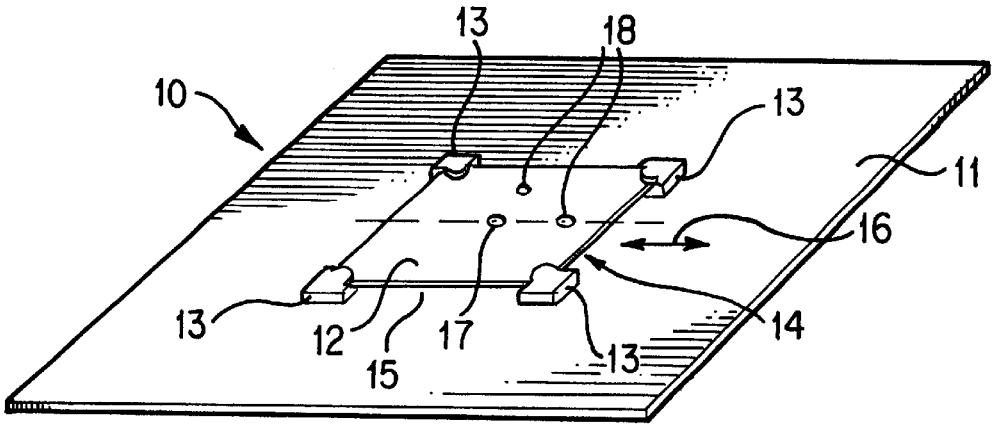
FIGS. 1A and 1B are perspective and side views, respectively, of the microstrip patch antenna of the present invention.
Figure 1B:
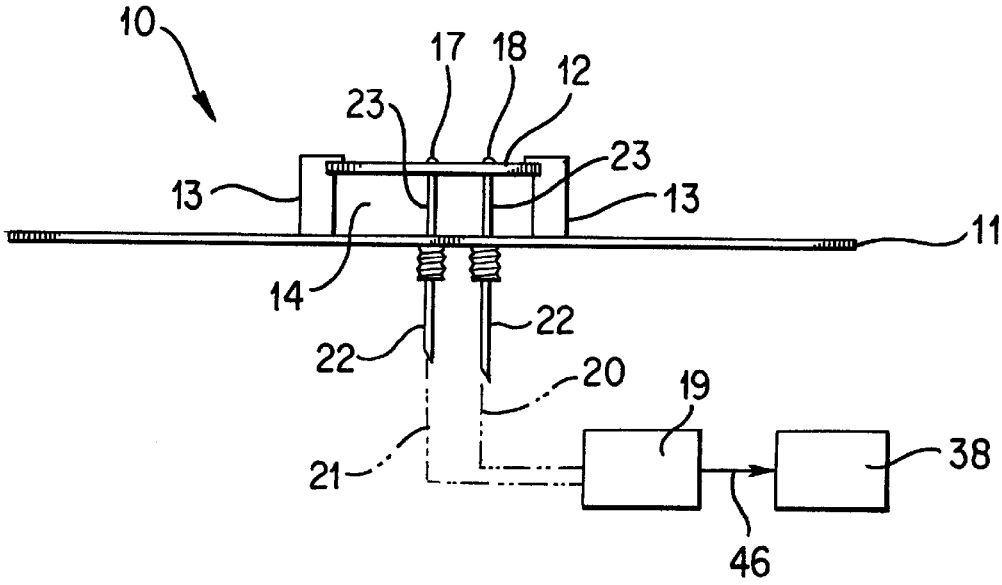

Referring to FIGS. 1A and 1B, a patch antenna 10 is provided which includes a conductive ground board 11, a radiating patch 12 which is spaced from the ground board 11, and a dielectric filled resonant cavity 14 defined between the ground board 11 and the radiating patch 12. The resonant cavity 14 may be filled with any dielectric applicable for patch antennas.

As best shown in FIG. 1B, the resonant cavity 14 is open on all four sides of the radiating patch 12, which defines side openings 15 functioning as the antenna apertures through which the antenna transmits and receives energy as indicated by the double headed arrow 16.

The ground board 11 is a conducting plane having a circular, rectangular, or triangular shape with sides generally dimensioned to about 300 mm or shorter. The radiating patch 12 may be of any acceptable symmetric shape, including square, circular, or triangular, however in the preferred embodiment the contour is square-shaped with dimensions changing in accordance with operating frequency and dielectric loading. The vertical distance or displacement between the radiating patch 12 and the ground board 11 is approximately 5 mm.

The antenna 10 has a central feed point 17 disposed at the geometric center of the radiating patch 12 and may include one, two, or four side feed points 18 equidistantly spaced from the central feed point 17 and arranged at 90° angular mutual disposition with respect to each other. Imaginary lines extending between the central feed point 17 and each of the side feed points 18 are orthogonal each with respect to the other. The predetermined distance between the central feed point 17 and each of the side feed points 18 is approximately 13 mm.

Figure 2:
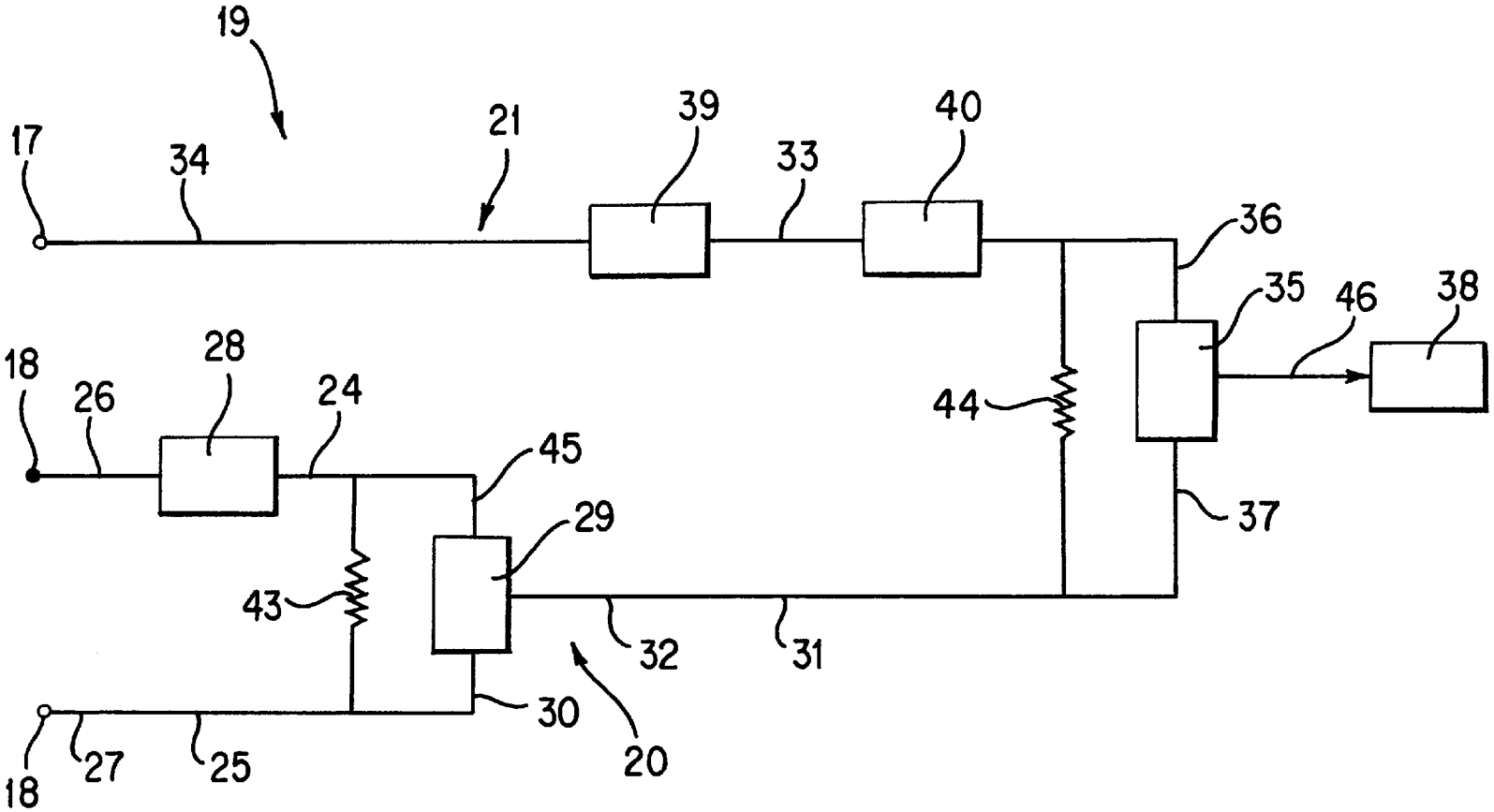
FIG. 2 is a schematic diagram of a feed network of the antenna system of the present invention.

A feed network 19, best shown in FIG. 2, includes a path 20 coupling fundamental modes of excitation to respective side feed points 18, and a path 21 coupling a higher mode of excitation to the central feed point 17. Each of the paths 20 and 21 includes a transmission line 22, best shown in FIG. 1B terminating in a feed probe 23 which protrudes through the ground board 11 at a predetermined location into contact with the radiating patch 12 and particularly in direct contact with one of the side feeding points 18 or the central feed point 17.

Figure 1C:
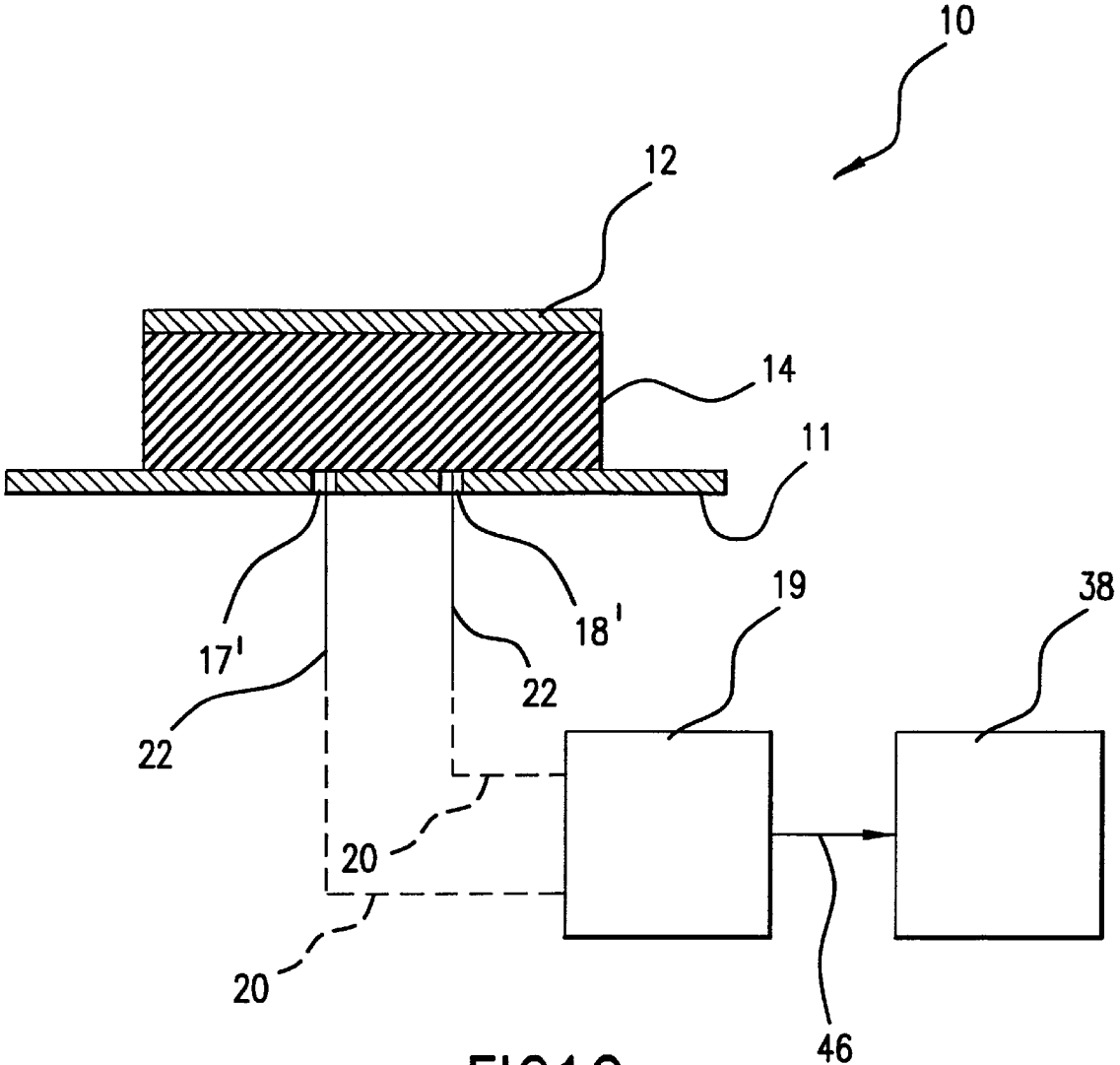
FIG. 1C is a cross-section of an alternative embodiment of the microstrip patch antenna of the present invention.

It is understood by those skilled in the art that the number of the transmission lines 22, as well as the number of the feed probes 23 in the antenna system 10 correspond to the overall number of the feed points, including the central feed point 17 plus the side feed points 18. Each feed probe 23 extends through the resonant cavity 14 in order that they inject or extract energy from the cavity. In an alternative embodiment shown in FIG. 1C, each feed probe may also have a form of an aperture 17', 18' in the ground plane 11 forming the dielectric filled resonant cavity 14.

Although arrangements having the central feed point 17 and one side feed point 18, or the central feed point 17 and four side feed points 18 is contemplated in the scope of the present invention, further description in following paragraphs, will be presented for the arrangement having the central feed point 17 and a pair of side feed points 18, which is particularly useful for GPS and wireless communication applications.

As such, the path 20 of the feed network 19 includes a pair of arms 24 and 25 with the end 26 of the arm 24 coupled to one of the side feed points 18 and with the end 27 of the arm 25 coupled to another side feed point 18. A 90° phase shifter 28 is coupled to either one of the arms 24 or 25.

Although the phase shifter 28 is shown in FIG. 2 as being connected to the arm 24, it will be readily understood by those skilled in the art that it can be couplable to the arm 25 as well. As shown in FIG. 2, the phase shifter 28 is connected between the end 26 of the arm 24 and the opposite end 45 thereof. A combiner 29 is connected between the end 45 of the arm 24 and the end 30 of the arm 25 to provide an output signal to a line 31 which is coupled by an end 32 thereof to the combiner 29.

The path 21 of the feed network 19 includes a line 33, the end 34 of which is coupled to the central feed point 17. A combiner 35 is coupled between the ends 36 of the line 33 and the end 37 of the line 31 for providing an output combined signal of both paths 20 and 21 to the processing means, for example, GPS receiver 38.

Figures 3A, 3B:
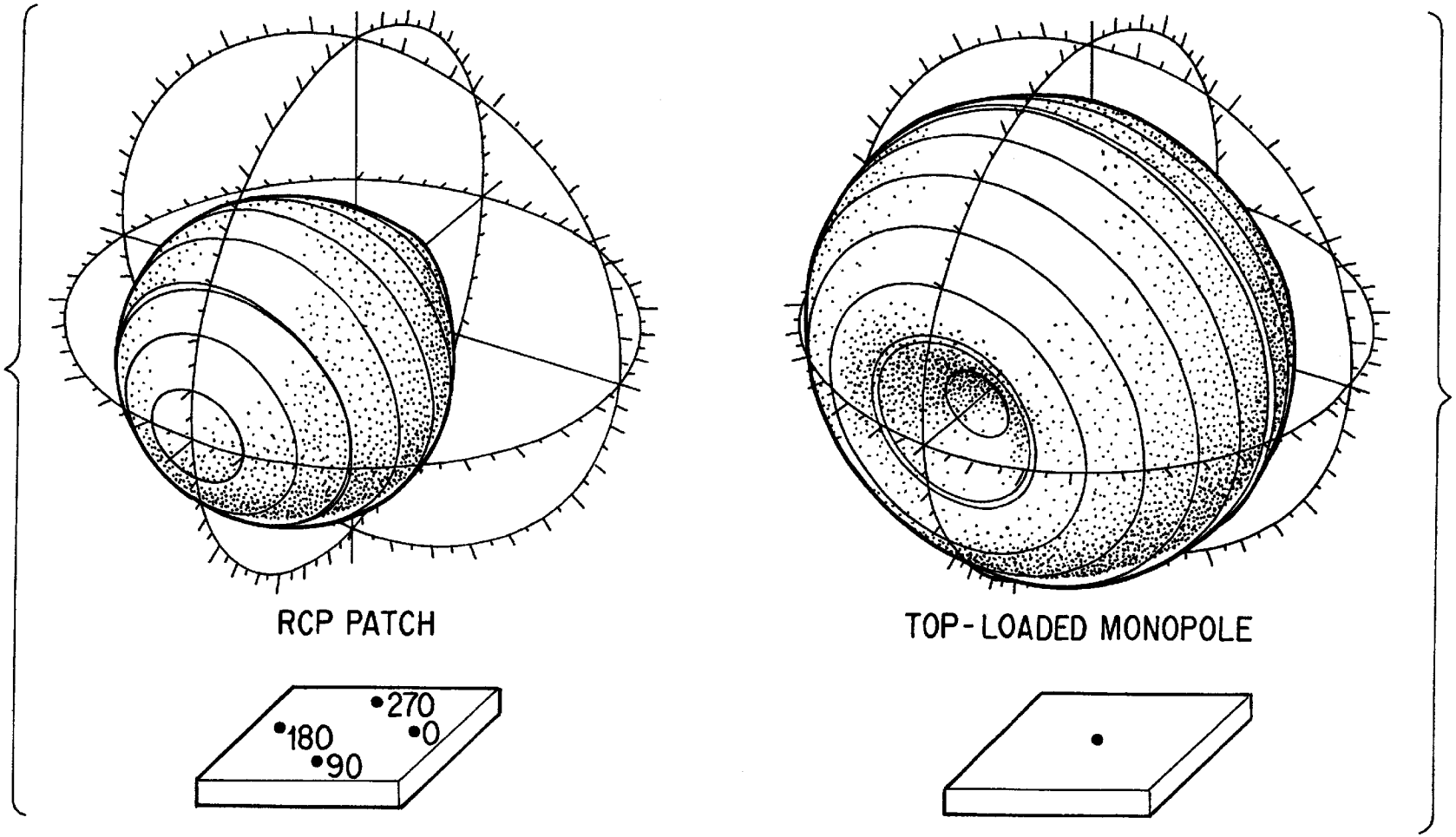
FIGS. 3A and 3B are illustrations of simulated right hand circularly polarized antenna pattern and top loaded monopole pattern.

The antenna 10 of the present invention has the ability to be fed in a manner which generates mode 1 and mode 2 patterns, three-dimensional representations of which are illustrated in FIGS. 3A and 3B. As shown in FIG. 3A, a typical right hand circularly polarized bore sight antenna pattern for receiving GPS signals is generated by feeding the antenna's side feed points 18 (through the path 20 of the feed network 19) with the fundamental TM010 and TM001 modes of excitation which are phase shifted by 90° by means of the phase shifter 28.

The higher order TM020 (or TM002)-like mode is also created simultaneously with the fundamental modes in the same radiating patch 12 by coupling these higher order modes to the central feed point 17 through path 21.

By coupling the higher order modes of excitation to the central feed point 17, a monopole antenna type pattern with a null at bore sight is generated, as shown by FIG. 3B. Higher order modes are below cut off due to the carefully chosen dimensions of the radiating patch 12 but can be weakly excited by matching the large higher order mode impedance at the center of the radiating patch 12. The fundamental mode pattern is a broad pattern that covers most of the sky hemisphere, while the higher order mode pattern has stronger lobes off-axis, however has a null located at bore sight.

Figure 4B:
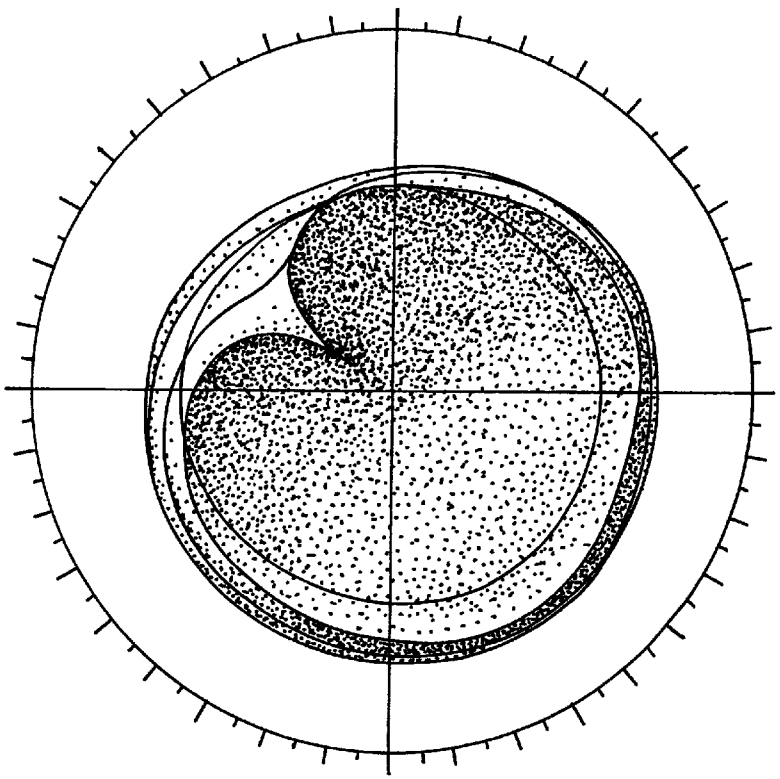
FIGS. 4A and 4B are rear projections of the simulated right hand circular polarized antenna gain pattern (shown in FIG. 4A) and the same pattern in combination with the higher order mode pattern (shown in FIG. 4B)
Figure 4A:
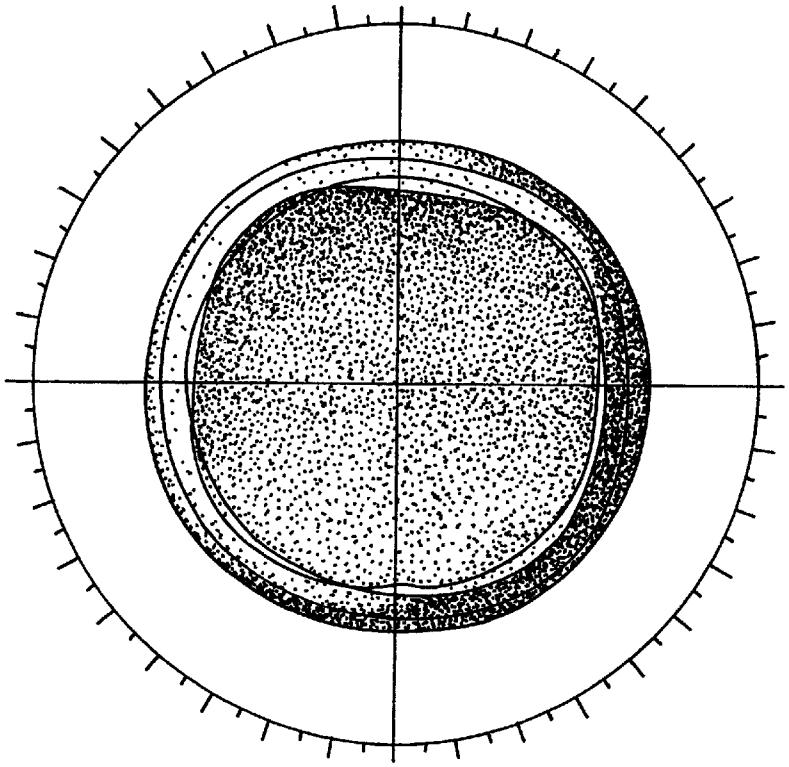

The importance of the present invention is found in that it shows that the combined radiation pattern having both a broad band receiving signal from GPS satellites and a spatial null created in the radiation pattern which may be generated in a miniature single element microstrip patch antenna. The combined radiation pattern, the rear projection of which is best shown in FIG. 4B has a deep spatial null in the vicinity of the horizon in contrast with the broad right hand circularly polarized pattern shown in FIG. 4A, which does not have any spatial null. The combined radiation pattern of the antenna of the present invention, therefore, enjoys both a broad band pattern and a deep spatial null.

Referring again to FIG. 2, an amplitude controller 39 and phase controller 40 are coupled to the line 33 between the ends 34 and 36 thereof. In an alternative embodiment, the amplitude controller 39 and/or phase controller 40, instead of the line 33, may be coupled to the line 31. The amplitude controller and phase controller, each coupled to either one of the lines 31 or 33, provides for amplitude and phase shift between fundamental and higher order modes of excitation and, as such, serve as a mechanism for steering the direction of the spatial null formed in the combined radiation pattern of the patch antenna 10.

Figure 5B:
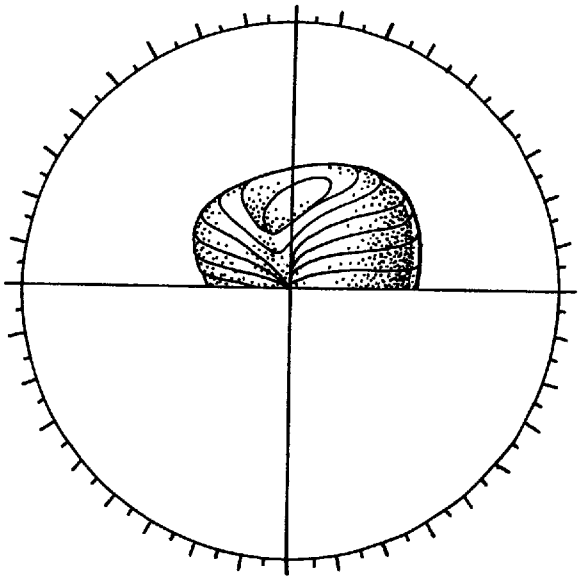
FIGS. 5A and 5B shows a simulated combined pattern formed in the antenna system of the present invention showing how amplitude variations steers null in elevation (shown in FIG. 5A), and how phase variation steers null in azimuth (shown in FIG. 5B); and, FIG. 6 is a measured pattern of a multi-mode adaptive antenna of the present invention.
Figure 5A:
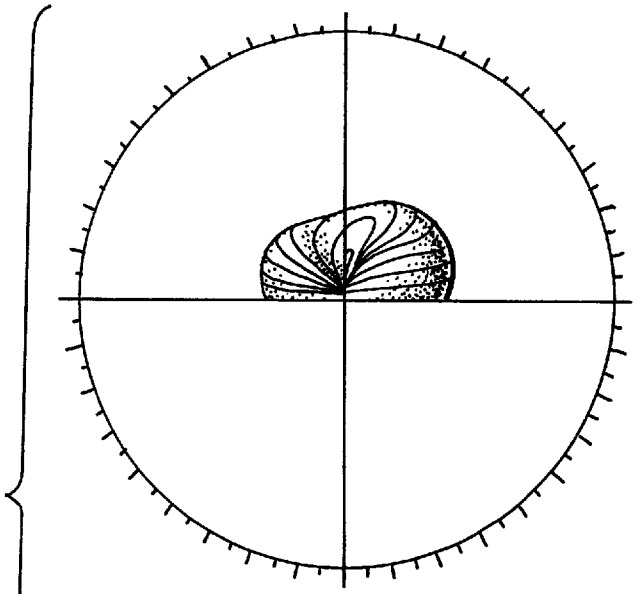

As best shown in FIG. 5A, the phase variation steers null in azimuth, while the amplitude variation steers the spatial null in elevation, shown in FIG. 5B. Steering of the spatial null by means of amplitude and phase shifting between the fundamental and higher order modes of excitation of the microstrip patch antenna 10 is another essential feature of the subject system. A conventional power source is used for operation of the amplitude and phase controllers (not shown in the Drawings). By properly weighting the amplitude and phase between the fundamental and higher order modes, a spatial null can be formed in a desired direction anywhere around 360° and specifically in the vicinity of the horizon where the jamming threat is greatest. A miniature adaptive nulling antenna of this type, when integrated with a low cost receiver 38 may be used for portable GPS or wireless applications.

The patch antenna 10 has provisions for five probes used for different excitations, one pair of side feed points 18 for each fundamental mode excitation (along the two principle axes) and one in the center of the patch to excite the higher order mode. The central feed point 17 is impedance matched using an impedance transforming circuit known to those skilled in the art.

The patch antenna 10 was designed to operate at the L1 (1575 MHz) GPS frequency band and is applicable to other bands as well. Unmatched, the fundamental mode side feed points 18 have a return loss of better than 10 db. The unmatched higher order mode excitation central feed point 17 has a very high input impedance (return loss of less than 1 db). Using the impedance transforming circuit to match the central feed point 17, a return loss of better than 10 db has been measured.

Figure 6:
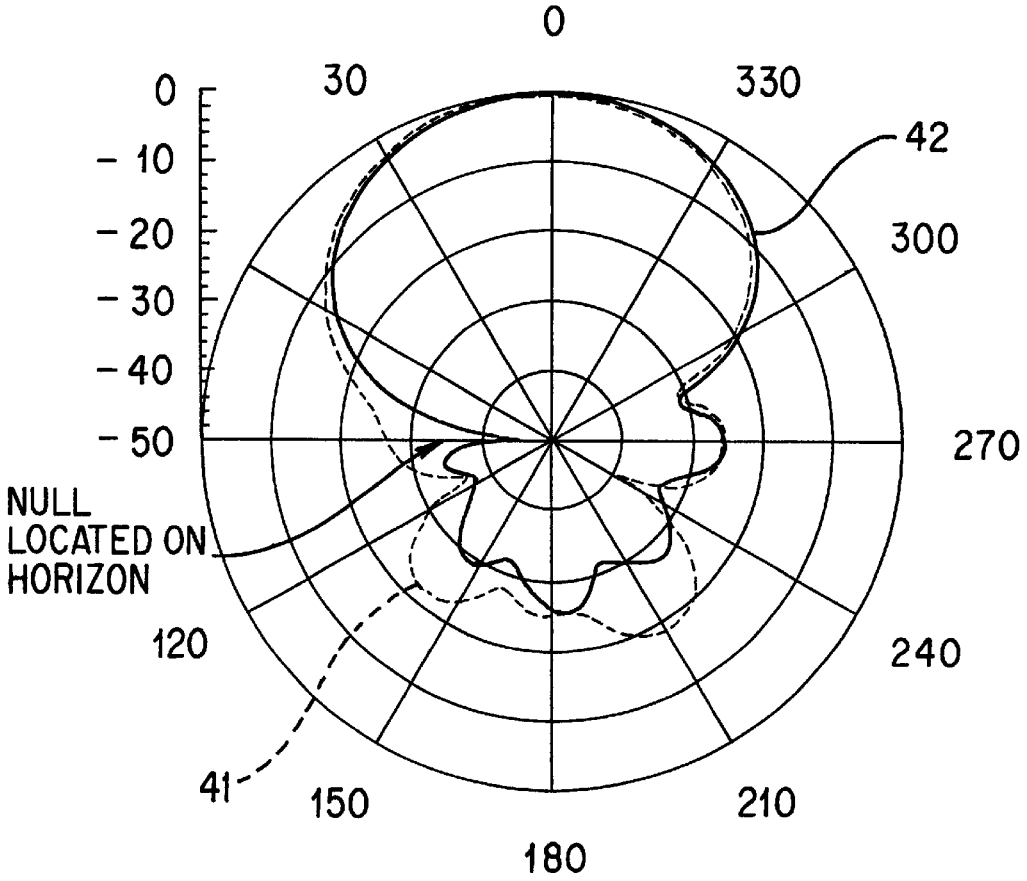

Isolation between the side feed points exciting the fundamental modes and the matched higher order modes was measured to be greater than 20 db. FIG. 6 is an example of measured antenna patterns taken in a near field antenna arrangement. During this experiment, the antenna was excited in linear polarization modes. FIG. 6 shows an elevation cut where 0° (zenith) is normal to the patch 12, while the horizon is located at 90 and 270°. The dashed line 41 shows the quiescent antenna pattern, while the solid curve 42 shows the formation of a spatial null of greater than 20 db at the horizon. This antenna is capable of steering a null in elevation by amplitude weighting of the two antenna modes (fundamental and higher order) and in azimuth by proper phase weighting of the same mode. The spatial null shown in FIG. 6 formed in the radiation pattern of the patch antenna 10 provides for rejection of interference, both intentional or unintentional.

The antenna system using a pair of side feed points 18, is particularly useful for GPS applications. However, the present invention is also operable by feeding one side feed point 18 with a fundamental mode of excitation which results in a linear polarization pattern. The feed network 19 for a linear polarization patch antenna is substantially the same with the exception that one of the arms 24 or 25, as well as the phase shifter 28 and combiner 29 are eliminated. However, the basic principle of the invention remains the same: providing a fundamental mode of operation on one path of the feed network, providing a higher order mode of excitation on another path of the feed network, and amplitude and phase shifting these modes of excitation with respect to each other.

It is possible to use all four side feed points 18 to form the antenna pattern. The feed network 19 will be substantially the same for side feed points 18 with the exception that another path similar to the path 20 of the feed network 19 should be added and the output combiner should be coupled to the system in order to combine output signals from all three paths to provide an output feed network signal for the GPS receiver 38.

In operation, a signal received from a GPS satellite antenna is obtained on the central feed point 17 and the side feed points 18. The signals obtained on the arms 24 and 25 are mutually 90° phase shifted and combined by the combiner 29. The combined signal from the output of the combiner 29 is supplied to the line 31 and propagates along the line 31 towards the combiner 35. The signal received at the central feed point 17 propagates along the line 33 and is combined with the signal transmitted along the line 31 in the combiner 35, the output of which constitutes the combined output signal of the feed network 19 which is supplied to the GPS receiver 38 through the line 46.

As disclosed, a microstrip patch antenna is a simple, low weight and low profile antenna using fundamental and higher order modes within the single rectangular, circular, or shaped otherwise, microstrip patch radiator to provide fair hemispherical coverage for a good GPS reception and to provide a null to reject jammers near the horizon and also to provide steering effect of a spatial null when the fundamental and higher order modes of excitation are amplitude and phase shifted with respect to each other.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described. Certain features may be used independently of other features, and in certain cases, particular locations of elements may be reversed or interposed, all without departing from the spirit or scope of the invention as defined in the appended Claims.

What is claimed is:

1. An antenna system, comprising:

a patch antenna, including:

a ground plane, a single radiating patch installed in spaced relationship to said ground plane and extending substantially parallel thereto, a dielectric filled resonant cavity located between said ground plane and said single radiating patch, a central feed point disposed at the geometric center of said single radiating patch, and at least one first side feed point on said single radiating patch disposed a predetermined distance from said central feed point; and a feed network, coupled to said central and said at least one first side feed point, said feed network including:

a first path for coupling at least a first fundamental mode of excitation to said at least one first side feed point, a second path for coupling a higher order mode of excitation to said central feed point to generate a top-loaded monopole radiation pattern, and means for controlling an amplitude and phase relationship between said at least first fundamental mode of excitation and said higher order mode of excitation, thereby creating a radiation pattern of said patch antenna having a directionally adjustable spatial null.

2. The antenna system of claim 1, further comprising:

a second side feed point on said single radiating patch, said second side feed point being spaced from said central feed point by a distance substantially equal to said predetermined distance, whereby imaginary lines extend between said central feed point and each of said first and second side feed points being orthogonal each with respect to the other;

said first path of said feed network further coupling a second fundamental mode of excitation to said second side feed point;

said first and said second fundamental modes of excitation being phase shifted by substantially 90°, thereby creating a circularly polarized radiation pattern of said patch antenna.

3. The antenna system of claim 2, including a Global Positioning System (GPS) receiver or wireless communications receiver, whereby a signal received by said patch antenna propagates from said central and said first and second side feed points through said feed network towards said GPS receiver.

4. The antenna system of claim 2, wherein said fundamental modes of excitation and said higher-order mode of excitation are respectively coupled to said side feed points and central feed point simultaneously, thereby creating said radiation pattern of said patch antenna, said radiation pattern constituting a combination of a circularly polarized radiation pattern and said top loaded monopole radiation pattern.

5. The antenna system of claim 2, wherein said first path of said feed network includes:

a first arm coupled at a first end thereof to said first side feed point, a second arm coupled at one end thereof to said second side feed point, a 90° phase shifter coupled to either one of said first and second arms between said first end thereof and a second end thereof, and first combiner means coupled between said second end of said first arm and a second end of said first arm and a second end of said second arm, a first line having first and second ends, coupled at said first end thereof to an output of said first combiner means;

said second path of said feed network includes a second line having first and second ends thereof coupled at said first end thereof to said central feed point;

amplitude control means for controlling signal amplitudes, said amplitude control means coupled in either one of said first and second lines between said first and second ends thereof;

phase control means for controlling signal phases coupled to either one of said first and second lines between said first and second ends thereof;

second combiner means coupled between said second ends of said first and second lines for combining output signals of said first and second paths of said feed network; and a third line coupled to an output of said second combiner means for receiving a combined output signal from said feed network and providing said combined output signal to a global positioning system receiver.

6. The antenna system of claim 5, wherein said phase control means controls location of the spatial null in azimuth.

7. The antenna system of claim 5, wherein said amplitude control means controls location of the spatial null in elevation.

8. The antenna system of claim 1, wherein each of said first and second paths of said feed network further includes at least one feed probe and at least one transmission line terminating in said feed probe, said at least one feed probe protruding through said ground plane towards said single radiating patch for direct electrical contact with a respective one of said side and central feed points thereon, and said feed probe extending through said dielectric filled resonant cavity for injecting and extracting energy therefrom.

9. The antenna system of claim 1, further including four side feed points equidistantly spaced from said central feed point and arranged on said single radiating patch at 90° mutual angular disposition therebetween.

10. The antenna system of claim 9, wherein each pair of adjacent side feed points of said four side feed points is fed with fundamental modes of excitation, phase shifted substantially 90° each with respect to the other.

11. A method of forming a radiation pattern having a spatial null of an antenna for a GPS (global positioning system) receiver, comprising the steps of:

providing a patch antenna including:

a ground board, a single radiating patch spaced from said ground board, a dielectric filled resonant cavity defined between said single radiating patch and said ground board, a central feed point defined in the geometrical center of said single radiating patch, and first and second side feed points on said single radiating patch substantially equidistantly spaced from said central feed point and disposed in angular orthogonal relationship therebetween;

providing a feed network, comprising:

a first path connected to said first and second side feed points, and a second path connected to said central feed point;

coupling first and second 90° phase shifted fundamental modes of excitation to said first and second side feed points through said first path, and simultaneously coupling a higher order mode of excitation to said central feed point, thereby creating a radiation pattern having a spatial null;

amplitude shifting said fundamental modes of excitation with respect to said higher-order mode of excitation, thereby steering said spatial null in elevation; and phase shifting said fundamental modes of excitation with respect to said higher-order mode of excitation, thereby steering the spatial null in azimuth.

* * * * *